United States Patent [19]

Balow et al.

[11] Patent Number: 4,961,378

[45] Date of Patent: Oct. 9, 1990

[54] ANTI-WRAP UP DEVICE FOR WEB FED PRINTING PRESSES

[75] Inventors: Frank A. Balow, Western Springs; Edward Enstrom, Oak Park; Eugene Skiper,Jr., Palos Hills, all of Ill.

[73] Assignee: Rockwell International Corporation, Pittsburgh, Pa.

[21] Appl. No.: 445,948

[22] Filed: Dec. 11, 1989

Related U.S. Application Data

[63] Continuation of Ser. No. 233,530, Aug. 18, 1988, abandoned, which is a continuation of Ser. No. 54,699, May 27, 1987, abandoned.

[51] Int. Cl.[5] ..... B41F 7/04; B41F 13/02; B65H 25/00

[52] U.S. Cl. ..... 101/142; 101/228

[58] Field of Search ..... 101/228, 219, 181, 420, 101/421, 216, 142, 143, 225, 227

[56] References Cited

U.S. PATENT DOCUMENTS

| | | | |
|---|---|---|---|
| 1,200,779 | 10/1916 | Thompson | 400/641 X |
| 1,229,180 | 6/1917 | Kurowski | 400/641 X |
| 1,554,253 | 9/1925 | Smith | 400/662 X |
| 1,957,291 | 5/1934 | Rees | 101/228 |
| 3,203,345 | 8/1965 | Gibbons | 101/228 |
| 4,074,626 | 2/1978 | Werner | 101/247 X |
| 4,252,059 | 2/1981 | Simeth | 101/247 X |
| 4,341,156 | 7/1982 | Kaeppner | 101/141 |
| 4,454,810 | 6/1984 | Mutsumoto | 101/141 |
| 4,508,033 | 4/1985 | Fischer | 101/228 |
| 4,603,631 | 8/1986 | Simeth | 101/141 X |

FOREIGN PATENT DOCUMENTS

| | | | |
|---|---|---|---|
| 558071 | 8/1932 | Fed. Rep. of Germany . | |
| 2651049 | 5/1978 | Fed. Rep. of Germany | 101/141 |
| 60251 | 5/1981 | Japan | 101/141 |
| 1408176 | 10/1975 | United Kingdom | 101/228 |

*Primary Examiner*—J. Reed Fisher

*Attorney, Agent, or Firm*—Nies, Kurz, Bergert & Tamburro

[57] ABSTRACT

An apparatus for protecting the printing cylinders of an offset printing unit against damage that can be caused by paper wrapping around on the blanket cylinder when there is a break in the web after it has left the printing unit. The apparatus includes a pair of web capturing inertial rollers between which the web passes, each of the rollers being freely rotatable and each have a plurality of circular web gripping rings which are in constant contact with the web so that the rollers are rotatably driven solely by the web. The gripping rings are laterally adjustable along the axis of rotation of their respective roller so as to permit the traveling web to be gripped in preselected positions in non-print areas.

1 Claim, 1 Drawing Sheet

ANTI-WRAP UP DEVICE FOR WEB FED PRINTING PRESSES

This application is a continuation of application Ser. No. 233,530, filed 8/18/88, now abandoned, which is continuation of Ser. No. 054,699, filed 5/27/87, now abandoned.

This invention relates to an apparatus for protecting the printing unit of a web fed printing press, usually the printing cylinders, against damage that can be caused by paper wrapping around on the blanket cylinder when there is a break in the web after it has left the printing unit. Generally, the apparatus comprises free turning rotational inertia means that cooperate in gripping the web between them and which are driven by the web so that they continue to draw the web forwardly when there is a web break downstream of the apparatus.

BACKGROUND OF THE INVENTION

PRIOR ART

In the production of printed web materials, as for example through the use of a web fed offset printing press, it is known that the web leaving the last printing unit carries ink which is not yet dry and it is further known that the web after leaving the press is often subject to rupture or breakage. When such breakage occurs, it is the normal occurrence that the broken end of the web will wrap around one of the rolls of the last printing unit, usually the blanket roll, and cause damage. Even if no damage results from the web wrapping around the blanket cylinder, it is difficult and time consuming to remove the wrapped around web from the press. Therefore, it has been known in the prior art to provide apparatus which is designed to prevent a broken web from wrapping around cylinders that are contained in the printing unit itself. In most of the prior art the web carrying wet ink passes between a pair of spaced apart rolls, so that the ink is not smeared, which rolls are designed to move together when a sensor detects a break in the web. Typical of this form of apparatus are those described in U.S. Pat. No. 4,549,485 and in British Patent No. 1408176. In U.S. Pat. No. 4,549,485 there are provided a pair of opposed gripping rollers 3 and 15 which are spaced apart during normal operation of the press but which can be moved into contacting relationship with the web when the web is ruptured. The movement of the rolls toward each other is effected when a suitable sensor such as a web tension sensor, detects that the web has been broken. A somewhat similar arrangement is described in the British Patent which was noted above. In both the U.S. patent and in the British patent the rolls that grip the web are driven by some suitable outside driving apparatus.

In another type of apparatus, specifically that described in U.S. Pat. No. 4508033, there are provided a pair of opposed rolls 14 and 15 which are rubber covered and are in constant contact with the traveling web. In this case the rolls are driven at a peripheral speed which is slightly greater than the linear speed of the printed web so as to maintain tension on the web that is exiting from the printing press.

It has been determined that while apparatus of the type referred to above are somewhat effective they still are not totally effective because on the one hand the reaction to grip a broken end depends upon sensing that the web has already been broken so that the gripping rolls do not always advance the web coming from the press in a reliable fashion. In addition, all of the rolls are driven so that speed adjustments must constantly be maintained to insure that there is uniformity of rotational speed of the gripping elements and the linear speed of the web to maintain proper tension. In addition, where the rolls are in total contact with the traveling web there is the problem of smearing or otherwise disturbing the ink that has been printed on the traveling web.

SUMMARY OF THE INVENTION

It is therefore a principal object of this invention to provide an improved capturing device for continuously withdrawing printed web from the last printing stand when a rupture has occurred downstream from the capturing apparatus.

It is a further object of this invention to provide an anti-wrap up device in which the gripping element are driven by the web so that the speed is identical to that of the traveling web.

An additional object of this invention is to provide an anti-wrap up device in which laterally adjustable gripping rings are provided that permit the traveling web to be gripped in pre-selected positions in non print areas.

Other and additional objects of this invention will be in part obvious and in part explained by reference to the accompanying specification and drawings in which:

FIG. 1 is a side elevation of the anti-wrap up device of this invention showing cooperating free turning rotational inertia means mounted as they engage the traveling web; and FIG. 2 is a front elevation of a portion of the anti-wrap up device of FIG. 1 showing the manner in which the free turning rotational inertia means are journaled in the frame and showing the manner in which the gripping means contact the traveling web.

DESCRIPTION OF THE PREFERRED EMBODIMENT

Figure 1:
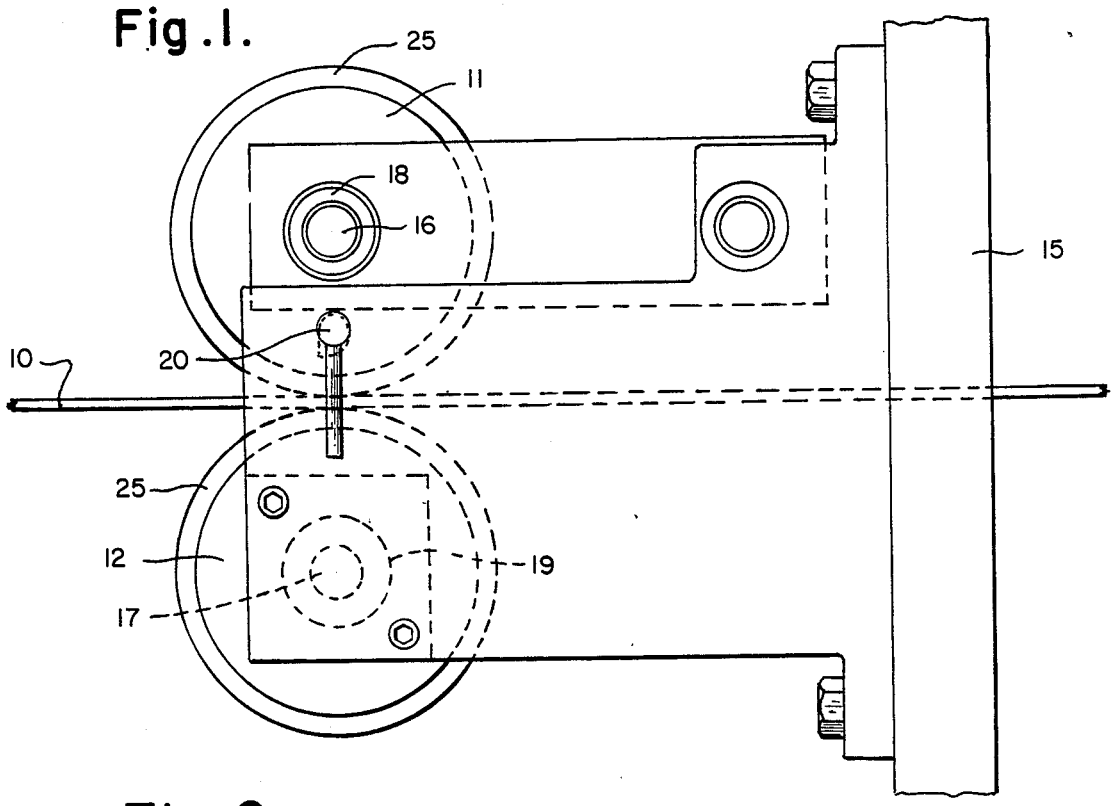

Referring to FIG. 1 of the drawings, there is shown a horizontally disposed traveling web 10 that passes between a pair of free turning rotational inertia means 11 and 12, hereshown as a pair of opposed rollers. It should be pointed out that although rollers are shown here as one embodiment it should be pointed out that any other inertial gripping means such as trolleys or wheels etc. may be used. The important thing is that the inertia means be in constant contact with traveling web 10 and be of sufficient mass as to provide continued rotation and contact with the web in the event of a web break downstream from the gripping apparatus.

The rollers or inertia means 11 and 12 are shown as being journaled in frame 15 by means of stub shafts 16 and 17 that are disposed within bearings 18 and 19 respectively. As can be seen most clearly in FIG. 2 of the drawings, a throw out mechanism 20 is provided for moving the upper roll 11 toward and away from the lower roll 12 to provide for disengagement when desired.

Since the ink on traveling web 10 is wet when it enters the nip between the inertia means or rollers 11 and 12, the apparatus of this invention provides gripper means 25 which take the form of rings that are disposed about the periphery of the inertia means 11 and 12. The gripping rings 25 may be secured to the rolls 11 and 12 by means of set screws or other fastening means so that they may be loosened and adjusted laterally along the length of the axis of the rollers 11 and 12. This is done in order that the rings can be placed in the non-printed areas which exist between printed columns on the web. In this manner the possibility of smearing or smudging or otherwise disturbing the freshly printed matter is eliminated.

Figure 2:
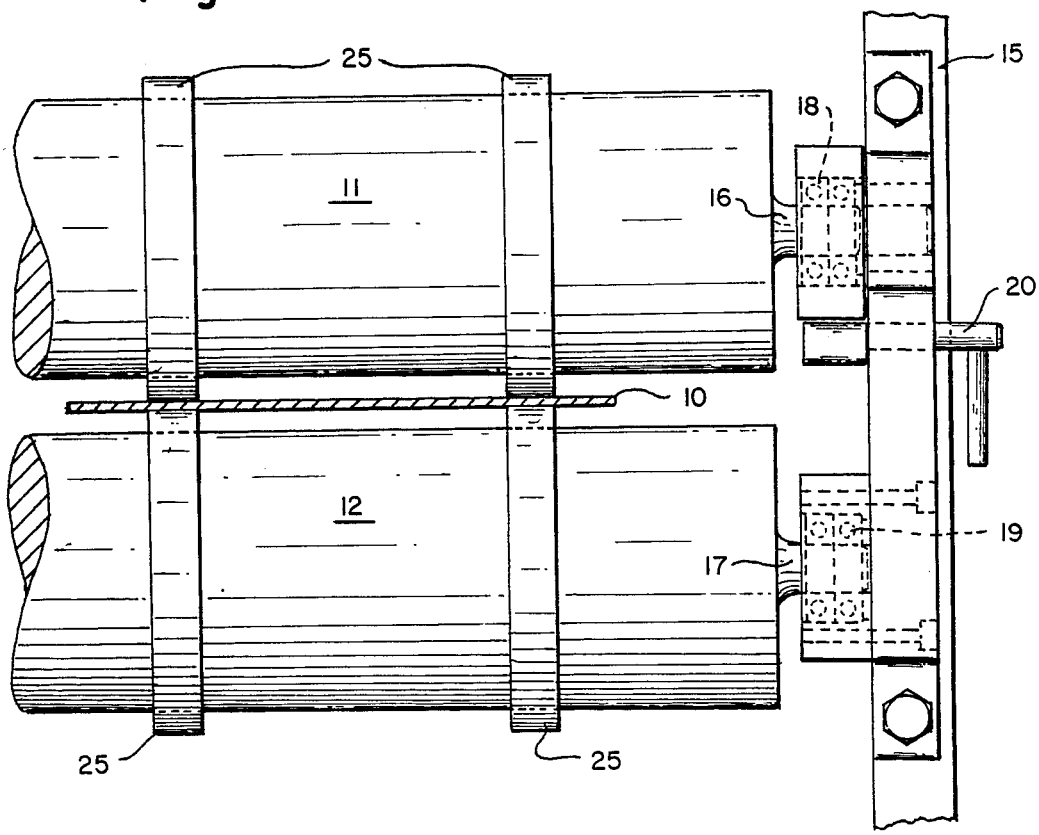

In operation, the throw out mechanism is used to move the roll 11 away from roll 12 as the web 10 is threaded through and on into subsequent processing apparatus such as a dryer or the like. The throw out mechanism then lowers the roll 11 into contact with the web as illustrated in FIG. 2 and the printing operation is initiated. It is obvious that as the web is drawn between the inertia means or rollers 11 and 12, it causes the rollers to rotate at exactly the same speed as the traveling web. In the event of a web break after the capturing or anti-wrap up device the inertial movement of the two opposing inertia means 11 and 12 will continue to draw web through the nip between them and prevent any wrap up about the printing rolls in the last printing unit. This device then does not require a signal to activate its capturing function, since the inertia of the device wants to continue to rotate even if the web is broken and wants to go slack. Therefore, it does not experience a delay and keeps the web in tension back to the printing unit. The loose end of the web is then accumulated past the anti-wrap up device (in a location that will not cause damage and is easy to clean).

What I claim and desire to secure by Letters Patent is:

1. In an offset lithographic printing press having support frame means, a printing couple comprised of a blanket cylinder and an impression cylinder mounted on said frame means, web capturing apparatus mounted on said frame means downstream of said printing couple for protecting the printing couple from damage in the event of web breakage after it exits the printing couple, said capturing apparatus comprising:

(a) a pair of web capturing inertial rollers between which the web passes, each of said rollers having a plurality of circular web gripping rings mounted thereon for contact with the traveling web;

(b) bearing means freely rotatably supporting said rollers on said support frame means with said gripping rings in normal constant contact with the web so that the rollers are rotatably driven solely by the web;

(c) throw-out means operatively associated with the bearing means supporting one of said inertial rollers whereby said bearing means can be moved to a position at which the gripping rings of the one supported roller are not in contact with the web; and (d) means providing adjustment of said gripping rings laterally along the axis of rotation of said inertial rollers for positioning said gripping rings in the margins between printed columns on the web.

* * * * *